US007377266B2

(12) United States Patent
Xi et al.

(10) Patent No.: US 7,377,266 B2
(45) Date of Patent: May 27, 2008

(54) INTEGRATED FUEL FEED APPARATUS

(76) Inventors: Daguang Xi, 8th Street, 3F, HuaDing Building, Hangzhou Economic and Technological Development Zone, Hangzhou, Zhejiang Province (CN) 310018; Yanxiang Yang, 8th Street, 3F, HuaDing Building, Hanzhou Economic and Technological Development Zone, Hangzhou, Zhejiang Province (CN) 310018; Changwen Liu, 8th Street, 3F, HuaDing Building, Hangzhou Economic and Technological Development Zone, Hangzhou, Zhejiang Province (CN) 310018

( * ) Notice: Subject to any disclaimer, the term of this patent is extended or adjusted under 35 U.S.C. 154(b) by 0 days.

(21) Appl. No.: 11/660,408

(22) PCT Filed: Jul. 4, 2005

(86) PCT No.: PCT/CN2005/000970

§ 371 (c)(1),
(2), (4) Date: Feb. 16, 2007

(87) PCT Pub. No.: WO2006/060942

PCT Pub. Date: Jun. 15, 2006

(65) Prior Publication Data

US 2007/0256667 A1 Nov. 8, 2007

(30) Foreign Application Priority Data

Dec. 8, 2004 (CN) ..... 2004 1 0089253
May 30, 2005 (CN) ..... 2005 1 0075607

(51) Int. Cl.
*F02M 37/04* (2006.01)
*F02M 37/08* (2006.01)

(52) U.S. Cl. ..... 123/506

(58) Field of Classification Search ..... 123/506, 123/514, 499, 467, 446, 497; 239/585.1–585.5, 239/88–95
See application file for complete search history.

(56) References Cited

U.S. PATENT DOCUMENTS 6,401,696 B1 * 6/2002 Heimberg ..... 123/499

(Continued)

FOREIGN PATENT DOCUMENTS

CN 1301330 A 6/2001

(Continued)

*Primary Examiner*—Mahmoud Gimie
(74) *Attorney, Agent, or Firm*—Jacobson Holman PLLC

(57) ABSTRACT

This invention relates to the engine technical field, more particularly, an integrated fuel feed apparatus. The integrated fuel feed apparatus including a driving member 20, a plunger pump 30 driven by said driving member, a fuel injector 90, a fuel intake member 13 and a fuel return member 14, with a return passage 15 always communicating the fuel intake member 13 with the fuel return member 14, with some of the fuel in the return passage 15 being ejected via the fuel injector 90 under the action of the plunger pump 30, featuring that the driving member consists of a solenoid 25, a sleeve 27 and a motion part 10 which can reciprocate in the sleeve 27 driven by the magnetic force of the solenoid 25, the aforesaid motion part 10 generating a flow difference while reciprocating in the aforesaid return passage 15, thus achieving the fuel flow from the fuel intake member 13 to the fuel return member 14. The integrated fuel feed apparatus specified in the present invention can actively restrain the generation of fuel vapor and further actively discharge the fuel vapor generated therein.

20 Claims, 3 Drawing Sheets

U.S. PATENT DOCUMENTS

| | | | | |
|---|---|---|---|---|
| 6,422,836 | B1 * | 7/2002 | Krueger et al. | 417/418 |
| 6,715,464 | B2 * | 4/2004 | Heimberg | 123/300 |
| 6,964,263 | B2 * | 11/2005 | Xi et al. | 123/499 |
| 7,121,264 | B2 * | 10/2006 | Frank et al. | 123/458 |
| 2004/0065304 | A1 * | 4/2004 | Xi et al. | 123/497 |

FOREIGN PATENT DOCUMENTS

| | | | |
|---|---|---|---|
| CN | 1458403 | A | 11/2003 |
| CN | 1133810 | C | 1/2004 |
| CN | 1474910 | A | 2/2004 |
| EP | 1336751 | A1 | 8/2003 |
| JP | 2002-195122 | | 7/2002 |
| JP | 2001-221137 | | 8/2002 |

* cited by examiner

INTEGRATED FUEL FEED APPARATUS

This is a national stage of PCT/CN2005/000970 filed 4 Jul. 2005 and published in Chinese.

FIELD OF THE INVENTION

The present invention, relating to the engine technical field, specifies electronically-controlled fuel injection apparatuses, more particularly, an electronic fuel injection apparatus employed on compact combustion engines.

BACKGROUND OF THE PRIOR ART

The present electronic fuel injection apparatus by BOSCH employs a rotary electromagnetic pump disposed in the fuel tank to feed fuel to the high-pressure passage wherein the fuel pressure is adjusted before it is introduced to the nozzle; thereafter the pressurized fuel is injected into the intake manifold in metered quantities between specified intervals under the control of the electronic control unit (ECU). When applied on compact high-speed engines such as those installed on motorcycles, the above-described fuel injection apparatus presents the problems of high cost, low reliability and severe fluctuation of intake pressure.

A new type of pulse electromagnetic fuel injection device disclosed in a Chinese patent publication No. CN1133810C entitled "Electronically Operated Fuel Injection Device" comprises a fuel intake member, a fuel driving member and a fuel injector; the magnetic flux generated by the actuating solenoid and the resetting solenoid of the fuel driving member drives the driven member which consists of an armature core and a plunger to achieve the circulation of fuel suction and fuel injection. The integrated fuel feed device provided in the aforesaid invention sucks fuel directly from the fuel tank via the low-pressure passage.

In actual applications, the integrated fuel feed devices may encounter certain problems such as strict installation manner, long standby time, hot restarting, long-time idling operation and high-load running under high temperature, and thereby the fuel vapor generated in the inner and outer passages thereof may severely disturb the normal fuel feed operation. Therefore a more preferable embodiment wherein the generation of fuel vapor can be restrained and further the generated fuel vapor can be timely discharged is imperative.

Another Chinese patent publication No. CN1474910A entitled "Electronically Controlled Fuel Injection System" particularly emphasizes the possibility of the aforesaid problems; thereby it installs a by-pass passage from the admission port of the intake passage to the outlet of the return passage between the solenoid and the cylinder to directly introduce the fuel back to the fuel tank. But it is still very possible that the fuel vapor would accumulate inside and outside the fuel feed device thereby to disturb the normal operation thereof because of certain problems such as the relatively stationary state of the constitution wherethrough the return flow passes, the lack of enough driving power and the over-sensitivity thereof to the installation manner. Based on the aforesaid patents, a third improved Chinese patent publication No. CN1458403A entitled "Electronically Controlled Fuel Injection Unit" preserves the return passage and further adds a check valve at the drain port thereof to prevent the fuel vapor from entering the pressure chamber.

The patents or patent applications mentioned above do not provide any mechanism to actively prevent the generation of fuel vapor and the driving power to discharge the generated fuel vapor, and still further the devices provided therein require strict installation manners, which actually keep them from completely eliminating the aforesaid problems.

SUMMARY OF THE INVENTION

The object of the present invention is to solve the above-mentioned problems by providing a reliable integrated fuel feed apparatus of simple constitution whereby the generation of fuel vapor can be actively restrained and further the generated fuel vapor can be actively discharged.

The objects of the present invention are attained by the following technical mechanisms.

An integrated fuel feed apparatus consists of a driving member employed to attain reciprocating motion, a plunger pump driven by said driving member, a fuel injector, a fuel intake member and a fuel return member, and a return passage always communicating the fuel intake member with the fuel return member, with some of the fuel in said return passage being ejected via the fuel injector under the action of the aforesaid plunger pump, featuring that the driving member consists of a solenoid, a sleeve and a motion part which can reciprocate in the aforesaid sleeve under the magnetic force of the aforesaid solenoid, and that the aforesaid motion part reciprocates in said return passage in the flow-difference generating mode thereby to achieve the fuel flowing from the fuel intake member to the fuel return member.

The present invention employs the accompanying flow caused by the reciprocation of the motion part in the return passage to achieve the fuel return flowing from the fuel intake member to the fuel return member. The reciprocation of the aforesaid motion part within the return passage will definitely generate an accompanying fuel flow with the characteristic of bidirectional pulses and the flow difference (net flow) thereof can generate three different flows including: the constant return flow from the fuel intake member to the fuel return member, the constant counter-return flow from the fuel return member to the fuel intake member and the flow with no definite flow directions. The constitution of said motion part and the motion manner thereof specified in the present invention are qualified for the first case wherein a constant return flow is attained.

The factors influencing the return flow include the constitution of the motion part, the layout of the return passage and the velocity ratio of reciprocating action, etc. They affect the aforesaid flow difference by increasing the return flow when the flow resistance encountered by the motion part in the resetting direction is larger than that encountered in the reverse direction because of the constitution of the motion part, increasing the return flow when the flow ratio in return direction is increased because of the constitution of the return passage, increasing the return flow when the velocity of motion part in the resetting direction (return direction) is increased because of the velocity ratio of the motion part, and still increasing the return flow when the effective flow area of the fuel passage is decreased because of the resetting motion of the motion part.

Said solenoid energized by PWM voltage wave generates a pulsed magnetic field to drive the motion part, and the magnetic force can be generated by one solenoid or two solenoids which can generate forces in different directions. In case of an unidirectional magnetic force, the counterforce thereof acted in the reverse direction should be provided by other devices such as springs or hydraulic devices.

One simple constitution for the motion part provided in the present invention adopts an armature.

Said armature comprises an armature passage serially communicated with the aforesaid return passage thereby to miniaturize the apparatus and reduce the motion resistance encountered by the armature.

An improvement to the aforesaid armature passage wherein the flow area at the intake is larger than or equal to that at the outlet in the return direction makes the flow resistance the armature encountered in the return direction larger than that in the reverse direction.

A further simplified constitution for the aforesaid armature passage wherein the armature passage penetrates through the center of the armature can not only make the magnetic field distribution more reasonable but also lower the manufacturing difficulty.

In addition to the abovementioned improvements, the armature also comprises an arched force transfer part crossing the intake of the armature passage at the front end of the armature where it makes contact with the plunger, thereby to reduce the flow resistance while the armature is driving the plunger pump. The aforesaid force transfer part may adopt an U shape or a radial shape and can be fastened on the armature and/or the plunger, or even be independent from the two aforesaid members.

The resetting motion of the aforesaid armature provided in the present invention in return direction is restricted by the aforesaid fuel return member, a boss is provided surrounding the intake of the armature passage at the rear end of said armature and a shoulder bore with a fitting shape with said boss located on the fuel return member can avoid said boss. Not only can the boss-shoulder bore constitution increase the flow resistance the armature encounters in return direction but also it can reduce the impact noise made by the armature and the fuel return member. According to this concept, the aforesaid boss and shoulder bore may interchange their locations, which means that the boss can be disposed on the fuel return member and the shoulder bore on the rear end of the armature, or other configurations can be adopted.

Another return passage, serially communicated with said return passage, is disposed on the fuel return member, comprising a rectifying section wherein the fuel can flow in both directions with a larger flow ratio in return direction.

The armature passage of the present invention is disposed between the armature and the sleeve, which facilitates the force transfer between the armature and the plunger.

The motion part of the present invention may also comprise a fuel return driving device that is synchronized with the armature; the fuel return driving device is disposed between the fuel return member and the armature with a dynamic return passage serially communicated with said return passage. The principle of said dynamic return passage is similar with that of the armature passage which makes the fuel return driving device encounter larger resistance in return direction than that in the reverse direction.

The plunger pump of the present invention comprises a plunger and a pressure chamber fitted with said plunger to deliver fuel. A suction passage is disposed between the pressure chamber and said return passage, and the plunger driven by said motion part fulfills the fuel suction/delivery strokes. When the plunger is in suction stroke, the fuel enters the pressure chamber via the drain passage; at the beginning of fuel delivery stroke, some of the fuel or fuel vapor within the pressure chamber is discharged via the drain passage and when said drain passage is closed by the motion of the plunger, the effective fuel delivery begins.

An improvement to the aforesaid plunger pump is that a suction check valve is disposed between the pressure chamber and the return passage. When the plunger is in suction stroke, the fuel enters the pressure chamber first via the suction check valve and then via the drain passage; at the beginning of fuel delivery, some of the fuel or fuel vapor within the pressure chamber is discharged via the drain passage and when the drain passage is closed by the motion of the plunger, the effective fuel delivery begins.

A further improvement to the aforesaid plunger pump is that a check-spill valve is serially communicated with said drain passage, communicating with said return passage, and thereby only via said suction check valve can the fuel enter the pressure chamber.

A still further improvement to the plunger pump of the present invention features that the drain passage communicates with said return passage by means of a suction-spill valve and a fuel intake disposed on the suction check valve on the return passage is communicated with the pressure chamber via said suction check valve.

Still another improvement to the plunger pump of the present invention features that a micromatic flow controller, comprising an orifice and a micromatic screw, is fitted between the pressure chamber and the return passage, with the orifice communicating the pressure chamber with the return passage and the micromatic screw controlling or even cutting off the fuel flow.

As for the integrated fuel feed apparatus of the present invention, a filter that can prevent bubbles or impurities from entering the pressure chamber can be fixed at the intake of the suction check valve of said plunger pump.

As for the integrated fuel feed apparatus of the present invention, the fuel injector may only comprise a fuel nozzle or also comprise a delivery valve and an atomizing nozzle to attain a better atomization and mixture result.

The aforesaid delivery valve comprises a valve chest, a valve seat and a spring; the valve chest may employ a spherical shape and the valve seat an axisymmetric curved surface, or a planar sheet for the valve chest and an elastic part for the valve seat.

The aforesaid atomizing nozzle comprises a nozzle chest, a nozzle stem and a spring; the conical or spherical section at the front end of the nozzle stem forms the nozzle chest with an intake orifice thereon and the pyramidal surface thereon forms the nozzle seat; a spring seat is fitted at the rear end of the nozzle stem and the axial clearance between it and the nozzle chest defines the maximum lift stroke of the nozzle stem. Additionally, a filter may be fitted at the nozzle intake to avoid the jam of the nozzle stem of the nozzle.

As for the aforesaid integrated fuel feed apparatus of the present invention, the atomizing nozzle of the fuel injector also comprises a dome fixed at its outlet with one or several fuel outlets thereon.

As for the nozzle stem of the atomizing nozzle, the ratio between the maximum flow area of the nozzle and the sectional area of the plunger should be limited below 0.025 when it opens.

The fuel is injected into the admission passage or cylinder of combustion engines via the aforesaid integrated fuel feed apparatus to implement intake-injection and direct injection in the cylinder.

The fuel feed apparatus of the present invention can be employed on compact engines of those including but not limited to automobiles, motorcycles, electric generators, petrol motors, light aeroplanes, speed boats, etc; it can also be adopted on petrol engines, diesel engines or other engines of substitute fuel; it can also be employed to implement intake-injection and direct injection in the cylinder of combustion systems.

DETAILED DESCRIPTION OF THE DRAWINGS

The invention will be better understood when read in conjunction with the appended drawings and preferred embodiments.

DETAILED DESCRIPTION OF THE PREFERRED EMBODIMENTS

Figure 1:
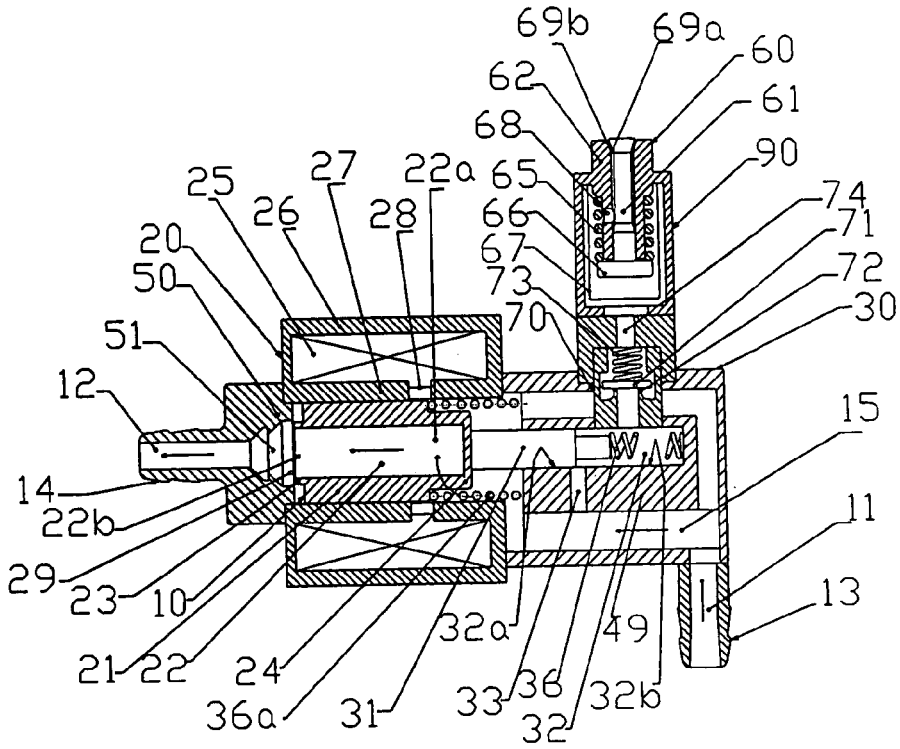
FIG. 1 is a schematic view of the first preferred embodiment of the integrated fuel feed apparatus of the present invention.

Embodiment 1: as depicted in FIG. 1, the integrated fuel feed apparatus of the present invention in the first preferred embodiment comprises a driving member 20 employed to implement reciprocating action, a plunger pump 30 driven by the aforesaid driving member, a fuel injector 90, a fuel intake member 13 and a fuel return member 14.

A normally open return passage 15 is disposed between the fuel intake member 13 and the fuel return member 14; some of the fuel in the return passage 15 is ejected via the fuel injector 90 under the action of the plunger pump 30 and the rest of the fuel is introduced to the fuel return member 14 via the return passage 15 under the action of the driving member 20.

The driving member 20 comprises a solenoid 25, a sleeve 27, a magnetic yoke 26, a magnetic gap 28 and a motion part 10 which can reciprocate in the aforesaid sleeve 27 under the magnetic force of the aforesaid solenoid 25.

The fuel return member 14 comprises a return passage 12, a return member chest 50 and a rectifying section 51, with the rectifying section 51 serially communicated with the return passage 15 and the return passage 12. The rectifying section 51 is a ladder-like echelon passage which makes the flow ratio of the fuel flowing through rectifying portion 51 in the return direction greater than that in the reverse direction. The fuel return member 14 communicates with the low pressure passage.

The motion part 10 comprises a substantially cylindrical armature 21 reciprocating lineally in the substantially cylindrical space of the sleeve 27; the lateral surface of the space is defined by the magnetic sleeve 27 and the non-magnetic magnetic gap 28, one end thereof is defined by the fuel return member 14 and the other end is defined by the plunger pump 30. A suitable clearance is kept between the armature 21 and the sleeve 27 to ensure high sliding performance of the armature 21; the armature 21 locates in the cylindrical space and can freely reciprocate therein. At the original position, namely at the beginning of each stroke, the front end of the armature 21 locates in the length of the magnetic gap 28.

The hollow center of the armature 21 forms the armature passage 22; the flow area at the intake 22*a* of the armature passage 22 should be greater than or equal to the minimum sectional area of the armature passage; a length of the passage is preferably tapered thereby to form the maximum flow area at the intake 22*a* and the minimum sectional area at the outlet 22*b* of the armature passage 22, which helps increase the flow resistance of the armature in the fuel return direction or decrease the flow resistance in the reverse direction. The armature 21 fulfils the fuel delivery action via the plunger 31 driven by magnetic force and the resetting motion thereof is achieved by the spring(s) 36 and/or 36*a*.

A boss 23, surrounding the armature passage 22, locates at the rear end of the armature 21; a shoulder bore 29 is opened at the intake of the rectifying section 51 of the fuel return member chest 50 to avoid the boss 23, and the depth and diameter of the shoulder bore 29 should be larger than or equal to the height of the boss 23 mounted on the rear end of the armature 21. When the resetting armature 21 approaches the fuel return member chest 50, a closed space tends to be formed between the rear end of the armature 21 and the end of the fuel return member chest 50; thereby the fuel in the closed space is confined and pressurized, which can buffer the impact of the armature 21 on the fuel return member chest 50; in addition, the boss-shoulder bore constitution facilitates the generation of flow difference in fuel return direction.

The plunger pump 30 comprises a plunger 31, a pump body 49, a pressure chamber 32 and a spring 36 provided in the pressure chamber 32 employed to reset the plunger. One or several springs 36 can be disposed in the pressure chamber 32 or at other locations wherefrom the spring force can be applied on the plunger 31.

The plunger 31 is substantially cylindrical, coaxially fixed with the armature 21, and moves in a cavity in the pump body 49. The armature 21 drives the plunger 31 to reciprocate by adjusting the arched load transfer part thereinbetween. The arched load transfer part 24 can be fixed at the intake of the armature passage 22, spanning or protruding from the armature 21; a load transfer part 24 of radial shape may also be fixed on the plunger 31 and it is also feasible to constitute the armature 21, the load transfer part 24 and the plunger 31 as a whole constitution as long as the fuel in the return passage 15 can fluently flow into the armature passage 22 of the armature 21.

The spring 36*a* is disposed between the pump body 49 and the armature 21, with one end thereof locating on the boss of the armature 21 and the other end freely contacting with the end of the pump body 49. The spring 36*a* can increase the resetting speed of the aforesaid armature, which can make the return flow easier, enhance the pumping capacity of the motion part, shrink the volume of the pressure chamber and thus make the fuel feed apparatus more compact. Under the action of the spring(s) 36 and/or 36*a*, the motion part 10 can attain enough resetting speed; the reciprocating action of the motion part 10 can generate a flow difference in the return passage 15 to keep the return flow from the fuel intake member 13 to the fuel return member 14.

Bores or flutes are opened on the pump body 49 to define a part of the return passage 15. The pump body 49 and the plunger 31 define the space for the reciprocating action of the plunger 31; one length cavity of the pump body 49 is the sliding wall 32*a* for the reciprocating action of the plunger 31 and the other length is the non-sliding wall 32*b* which does not contact with the plunger 31. The drain passage 33 communicating the pressure chamber 32 with the return passage 15 is disposed on the sliding wall 32*a* which fits with the plunger 31 according to the requirements of conventional plunger fuel pumps; the pressure chamber 32 is defined by the space between the pump body 49 and the plunger 31.

At the original position of the delivery stroke of the plunger 31, the drain passage 33, the pressure chamber 32 and the return passage 15 are communicated; the armature 21 drives the plunger 31 towards the pressure chamber 32 and some of fuel together with the possible vapor in the pressure chamber 32 flows out via the drain passage 33; when the drain passage 33 is closed by the motion of the plunger 31 and the pressure of pressurized fuel in the pressure chamber 32 exceeds the predetermined value, the fuel flows to the fuel injector 90 and the fuel delivery stroke terminates. Then the plunger 31 begins the suction stroke under the action of the spring 36 and when the drain passage 33 opens again, the fuel enters the pressure chamber 32 via the drain passage 33 and the armature 21 reaches the terminal stage of resetting stroke; the possible fuel vapor in the return passage 15 is taken away from the drain passage 33 under the action of the motion part 10 which is moving in the fuel return direction and thereafter fresh fuel flows into the drain passage 33, thus the possibility of fuel vapor to enter the pressure chamber 32 is reduced.

The intake of the fuel injector 90 is set on the non-sliding wall 32*b* of the pressure chamber 32. The fuel injector 90 comprises a delivery valve 70 and an atomizing nozzle 60, and the delivery valve 70 consists of a valve chest 71, a valve seat 72 and a spring 73, the valve chest 71 employing a spherical shape and the valve seat 72 employing an axisymmetric curved surface, or a planar sheet for the valve chest 71 and an elastic part for the valve seat 72.

The atomizing nozzle 60 comprises a nozzle chest 62, a nozzle stem 61 and a spring 65; the conical or spherical section at the front end 69*a* of the nozzle stem 61 forms the nozzle chest and the pyramidal surface 69*b* on the nozzle chest forms the nozzle seat; under the reaction of the spring 65 the nozzle stem 61 locates on the pyramidal surface 69*b*, making the atomizing nozzle 60 be in off-state and an intake orifice 68 is opened on the nozzle chest 62. A spring seat 66 is disposed at the rear end of the nozzle stem and the axial clearance between it and the nozzle chest 62 defines the maximum lift stroke of the nozzle stem 61.

The injection orifice 74 functions as the outlet of the delivery valve 70 and a screen 67 is disposed between the injection orifice 74 and the intake orifice 68 to prevent impurities from entering the fit clearance between the nozzle stem 61 and the nozzle chest 62 through the intake orifice 68.

When the pressure of the pressure chamber 32 reaches the predetermined value, the fuel enters the fuel cavity of the fuel injector 90, goes through the screen 67 and then enters the nozzle chest through the intake orifice 68; when the fuel pressure exceeds the reaction of the spring 65, the nozzle stem 61 protrudes outwardly and the nozzle opens to eject the fuel.

The axis of the fuel injector 90 of the present invention may be parallel with or perpendicular to the motion direction of the plunger 31, or even a specific angle may be kept thereinbetween to obtain the optimum nozzle spray angle.

The fuel intake member 13 comprising an intake passage 11 is communicated with the external low-pressure fuel passage and the intake passage 11 is communicated with the return passage 15 of the plunger pump 30.

The operation of the integrated fuel feed apparatus disclosed in the present invention is as follows.

At the beginning of each stroke cycle, the front end of the armature 21 locates within the length of the non-magnetic magnetic gap 28, and the solenoid 25 generates a pulsed magnetic field energized by the inputted PWM voltage wave to drive the armature 21; the armature 21 depresses the plunger 31 down via the force transfer part 24, then the springs 36*a* and 36 are depressed and the fuel delivery stroke begins.

At the beginning of pressurization, the drain passage 33 locating on the sliding wall 32*a* of the pressure chamber 32 communicates with the pressure chamber 32 and the return passage 15; thereafter some of the fuel together with the possible fuel vapor in the pressure chamber 32 is discharged via the drain passage 33 into the return passage 15.

The plunger 31 continues moving down and closes the drain passage 33, and then the fuel in the pressure chamber 32 is pressurized; when the pressure of the pressure chamber 32 rises to the predetermined level, the delivery valve 70 opens and the fuel in the pressure chamber 32 enters the fuel cavity of the fuel injector 90 and goes through the screen 67 to filter impurities out; when the fuel pressure exceeds the reaction of the spring 65, the nozzle stem 61 extends outwardly and the fuel enters the bottom of the nozzle seat 69*b* via intake orifice 68 opened on the nozzle chest 62 and the fuel is ejected afterwards. When the force against the nozzle stem 61 applied by the fuel pressure of the nozzle chest 62 is smaller than the reaction of the spring 65, the nozzle stem 61 begins to move back and the nozzle closes afterwards.

When the solenoid 25 is deenergized the fuel injection terminates; the plunger 31 is reset under the reaction of the spring 36, the fuel suction stroke begins synchronously and thereby the fresh fuel enters the return passage 15 via the intake passage 11; when the motion of the plunger 31 opens the drain passage 33 again, fuel is sucked into the pressure chamber 32 via the drain passage 33. At the same time, the fuel in the return passage 15 is discharged from the fuel return member 14 via the return passage 15 and the armature passage 22 to cool the apparatus and discharge air bubbles. When the armature 21 returns to its original location, namely the end of the shoulder bore 29 provided on the fuel return member chest 50, the front end of armature 21 also returns to the magnetic gap 28 and the next stroke cycle is ready.

Because of the relation between the geometric constitution of the armature passage 22 and the fuel return member chest 50, and the enough spring reaction, the reciprocation of the armature 21 can generate enough net return flow, which can effectively cool the apparatus and discharge the fuel vapor to stabilize the fuel injection.

Figure 2:
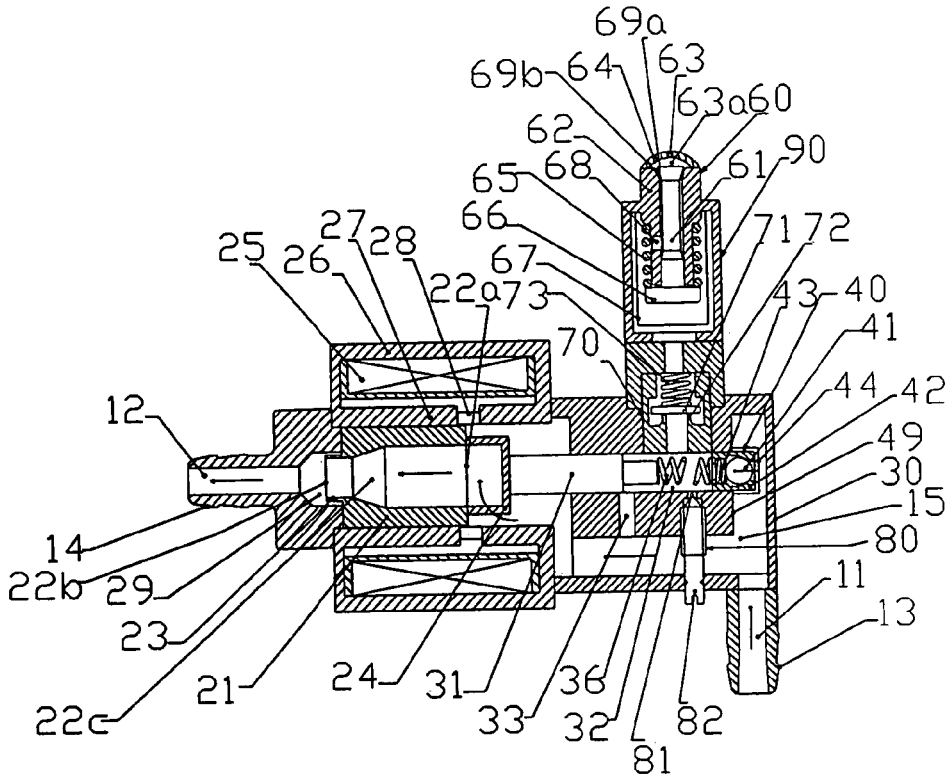
FIG. 2 is a schematic view of the second preferred embodiment of the integrated fuel feed apparatus of the present invention.

Embodiment 2: as depicted in FIG. 2, the armature 21 of the motion part of this embodiment comprises a tapered passage 22*c* which generates a flow difference in the return direction by making the flow resistance encountered by the armature 21 in return direction larger than that in the reverse direction during the reciprocating motion of the armature 21.

The boss 23 surrounding the armature passage 22 is disposed at the rear end of the armature 21; a shoulder bore 29 is opened on the fuel return member 14 to avoid the boss 23 and the depth and diameter thereof should be larger than or equal to the height and diameter of the boss 23 provided at the rear end of the armature 21. When the armature 21 approaches the fuel return member 14 in resetting motion, a closed space tends to be formed between the rear end of the armature 21 and the end of the fuel return member 14. The fuel in the closed space is confined and compressed thereby to buffer the impact of the armature 21 on the fuel return member 14; in addition, the boss-shoulder bore configuration further helps the generation of flow difference in fuel return direction.

An improvement to the plunger pump 30 is that a suction check valve 40 is fitted between the pressure chamber 32 and the return passage 15, and the outlet thereof locates on the non-sliding wall of the pressure chamber 32, which can reduce the resetting resistance encountered by the plunger 31 in resetting motion and further make the fuel vapor less possible to enter the pressure chamber. A filter 44 is fitted at the intake of the suction check valve 40, which may be a conventional filter screen.

The suction check valve 40 comprises a valve chest 41, a spring 43 and a valve seat 42 wherein the shape of the valve chest 41 can be spherical and that of the valve seat 42 can be an axisymmetrically curved surface.

The suction check valve 40 is closed at the pressurization stage. At the beginning of the suction stroke, the drain passage 33 closes and the pressure in the pressure chamber 32 is low; then the suction check valve 40 opens and the fuel in the return passage 15 flows into the pressure chamber 32 via the open suction check valve 40; the plunger 31 continues to rise until the drain passage 33 opens, and then the fuel flows into the pressure chamber 32 simultaneously via the suction check valve 40 and the drain passage 33.

A micromatic flow controller 80 is fitted between the pressure chamber 32 and the return passage 15, comprising an orifice 81 and a micromatic screw 82. The orifice 81 communicates with pressure chamber 32 via the return passage 15 and the fuel flowing through the orifice 81 can be cut off or adjusted via the micromatic screw 82. The installation of the micromatic flow controller 80 is to stabilize the fuel flow.

In this embodiment, a further improvement to the fuel injector 90 is that a dome 63 is fitted at the front end of the atomizing nozzle 60 in its spray direction and therefore a residual space 63*a* is formed at the front end of the nozzle chest 62 between dome 63 and nozzle stem 61. One or several ports 64 may be opened on the dome 63 according to the specific location of the fuel feed apparatus to adjust the fuel spray angle.

When the force applied on the nozzle stem 61 generated by the fuel pressure is large enough to overcome the reaction of the spring 65, the nozzle stem 61 moves towards the residual space 63*a*, the nozzle opens afterwards, and then the fuel is ejected via at least one of the ports 64 opened on the dome 63.

See embodiment 1 for other aspects.

Figure 3:
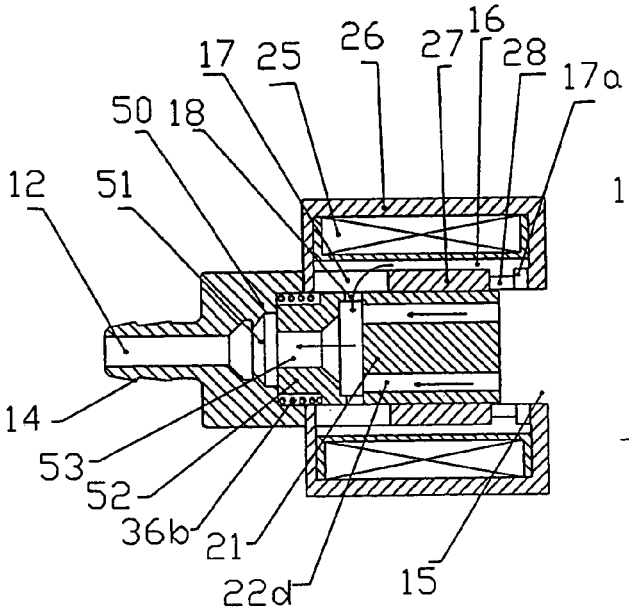
FIG. 3 is a partially schematic view of the third preferred embodiment of the integrated fuel feed apparatus of the present invention.

Embodiment 3: as depicted in FIG. 3, the motion part 10 of the fuel feed apparatus in the third embodiment of the present invention also comprises a fuel return driving device 52 in synchronized motion with the armature 21, disposed between the fuel return driving device 52 and the armature 21. A dynamic return passage 53 serially communicating with said return passage 15 is opened on the fuel return driving device 52, which is a tapered passage with a larger intake such as to make the flow ratio of the fuel flowing through the dynamic return passage 53 in fuel return direction larger than that in the reverse direction. A lateral passage 18 is provided on the sidewall of the fuel return driving device 52, leading from the dynamic return passage 53 to the sliding wall.

The fuel return driving device 52 is synchronized with the armature 21 via the spring 36*b* disposed at the front end of the fuel return driving device 52. The spring 36*b* also facilitates the armature 21 to reciprocate in a flow-difference mode. The fuel return driving device 52 can be firmly fixed onto or closely attached against the armature 21 coaxially or non-coaxially. The armature 21 may comprise no fuel passage, or one or several armature passages 22*d* can be provided therein. A by-pass passage 16 is opened between the sleeve 27 and the solenoid 25. The lateral passages 17 and 17*a* are opened on the sleeve 27 near the ends of the armature 21, the axial length of which respectively covers the motion scope of the two ends of the armature 21; thus at any time, the fuel can flow into the by-pass passage 16 from the return passage 15 via the lateral passage 17*a*, then into the lateral passage 18 via the lateral passage 17 and into the dynamic return passage 53 afterwards. Thus, the return passage 15, the lateral passage 17*a*, the by-pass passage 16, the lateral passage 17, the lateral passage 18 and the dynamic return passage 53 together form a persistently communicated passage. Therefore even if the flow area of the armature passage 22*d* were too small or even of no armature passage 22*d*, the communicated passages can also generate a return flow by the reciprocating motion of the fuel return driving device 52 and the armature 21.

A part of the lateral passage 17*a* may spatially overlap with the magnetic gap 28 which is made of non-magnetic materials such as copper, etc.

A boss-shoulder bore configuration can be established between the fuel return driving device 52 and the fuel return member 14 to buffer impact and help generate the flow difference in fuel return direction. A conically stepped rectifying section 51 may be disposed on the fuel return member 14 to enhance the fuel return capacity.

See embodiment 1 for other aspects.

Figure 4:
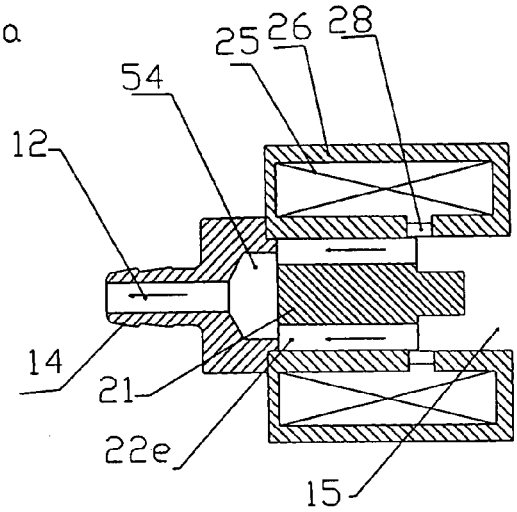
FIG. 4 is a partially schematic view of the fourth preferred embodiment of the integrated fuel feed apparatus of the present invention.

Embodiment 4: embodiment 4 depicted in FIG. 4, like embodiment 3, is an improved embodiment for the driving member wherein the armature passage 22*e* is a lateral bore or groove opened on the sidewall of the armature 21. The armature passage 22 plays the role of lightening the armature 21, reducing the motion resistance and improving the high-velocity performance of the armature 21. The armature passage 22*e* is serially communicated with the return passage 15.

In this embodiment, a return cavity 54 oriented towards the armature is provided on the fuel return member 14. It can be an orifice serially communicating with the return passage 12. The size of the orifice should match with that of the armature passage 22*e* so that the communication between the armature passage 22*e* and the return cavity 54 can be ensured when the armature makes close contact with the fuel return member, that is the intake of the return cavity 54 should overlap with the armature passage 22*e* to some extent. When the armature 21 returns near to the fuel return member 14, the effective flow area of the armature passage 22*e* shrinks and the resistance the armature encounters reduces, which helps to generate the flow difference in fuel return direction. The generation of flow difference in fuel return direction helps to discharge the heat and the fuel vapor.

See embodiment 2 for other aspects.

Figure 5:
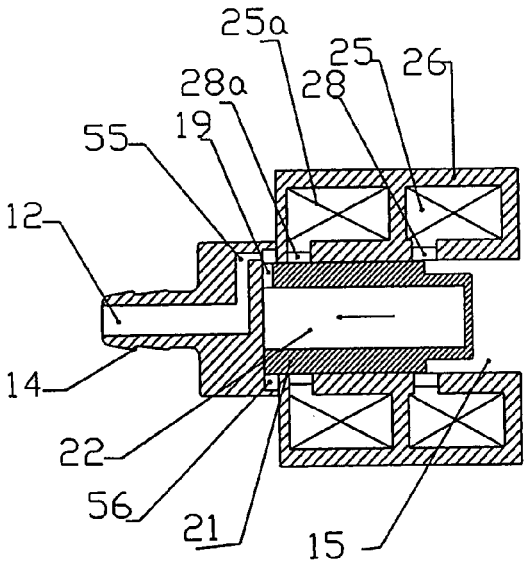
FIG. 5 is a partially schematic view of the fifth preferred embodiment of the integrated fuel feed apparatus of the present invention.

Embodiment 5: as depicted in FIG. 5, the fuel return member 14 of embodiment 5 comprises a passage consisting of a passage 55 and a circumferential groove 56 communicated with said passage. The armature 21 comprises an armature passage 22 and a lateral orifice 19 at the rear end of armature 21 communicated with the armature passage 22. When the armature 21 returns near to the fuel return member 14, the circumferential groove 56 will be covered by the sidewall of armature 21, and when the rear end of the armature 21 makes close contact with the end of the fuel return member 14, the circumferential groove 56 communicates with the armature passage 22 merely via the lateral orifice 19, and during this process the return motion of the armature 21 shrinks the effective flow area of the armature passage 22, therefore the resistance encountered by the armature increases, which is helpful to enlarge the return flow rate.

The embodiment presents a constitution which can enhance the stroke rate of the apparatus, wherein the driving member 20 comprises a working solenoid 25*a*, a homing solenoid 25, a magnetic gap 28*a* and a homing magnetic gap 28*a*, and the working solenoid 25*a* is coaxially disposed with the homing solenoid 25, both controlled by an individual PWM to generate the alternating magnetic field. The magnetic field generated by working solenoid 25*a* drives the armature 21 to move in positive direction whereas the magnetic field generated by the homing solenoid 25 resets said armature 21. Not only can the improved embodiment accelerate the resetting velocity of the armature 21 such as to increase the return flow rate, but also it can improve the stroke rate thereof.

See embodiment 1 for other aspects.

Figure 6:
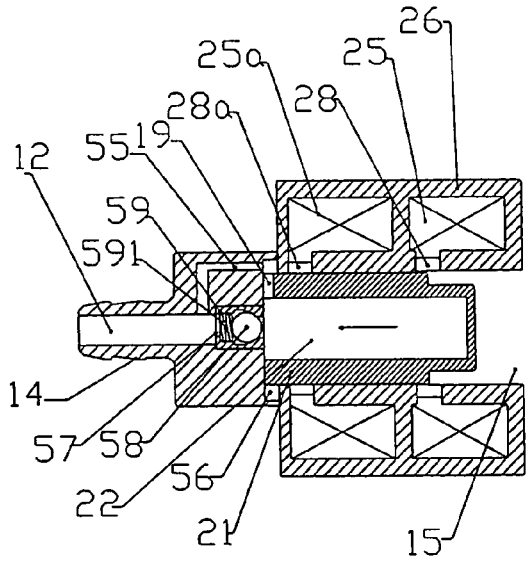
FIG. 6 is a partially schematic view of the sixth preferred embodiment of the integrated fuel feed apparatus of the present invention.

Embodiment 6: embodiment 6 as depicted in FIG. 6 differs with embodiment 5 in that a check valve 50, comprising a valve chest 58, a spring 591 and a valve seat 59, is disposed between the armature passage 22 and the fuel return passage 12, valve chest 50 being spherical and valve seat 59 being an axisymmetric curved surface, or valve chest 50 being a planar sheet and valve seat being an O ring. The intake of the check valve 50 communicates with the armature passage 22 and the outlet thereof locates on the fuel return passage 12.

The check valve 50 is in parallel communication with the passage 55 such as to ensure the continuous connectivity of the passage 15. The check valve 50 makes the flow ratio of the fuel return passage 12 in fuel return direction greater than that in the reverse direction such as to increase the fuel flow rate.

See embodiment 5 for other aspects.

Figure 7:
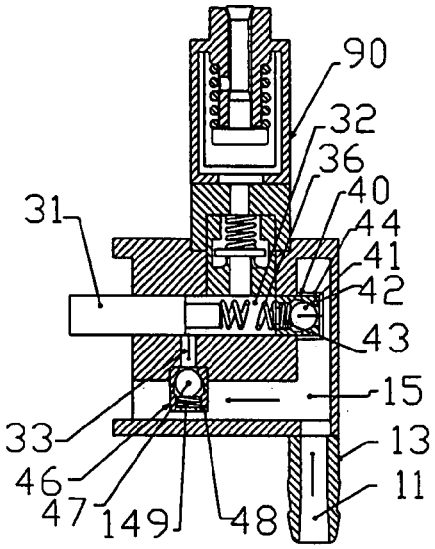
FIG. 7 is a partially schematic view of the seventh preferred embodiment of the integrated fuel feed apparatus of the present invention.

Embodiment 7: as depicted in FIG. 7 a further improvement to the plunger pump 30 of embodiment 1 features that a suction check valve 40 is fitted between the pressure chamber 32 and the fuel return passage 15, the outlet thereof locating on the non-sliding wall of the pressure chamber 32. A check-spill valve 46 communicating with the fuel return passage 15 is serially communicated with the drain passage 33 and the outlet thereof is disposed on the fuel return passage 15. The suction check valve 40 comprises a valve chest 41, a spring 43 and a valve seat 42 and a filter 44 can be fitted at the outlet thereof.

The spill valve 46 comprises a valve chest 47, a spring 149 and a valve seat 48 wherein the spring 149 may not be used if the valve chest 47 can drop under gravity.

Throughout the suction process, the drain passage 33 is closed by the check-spill valve 46 and all fuel introduced into the pressure chamber 32 is fed by the suction-check valve 40 and thus the fuel vapor in the fuel return passage 15 is cut off, which further prevents the fuel vapor from entering the pressure chamber 32 by way of the drain passage 33.

Figure 8:
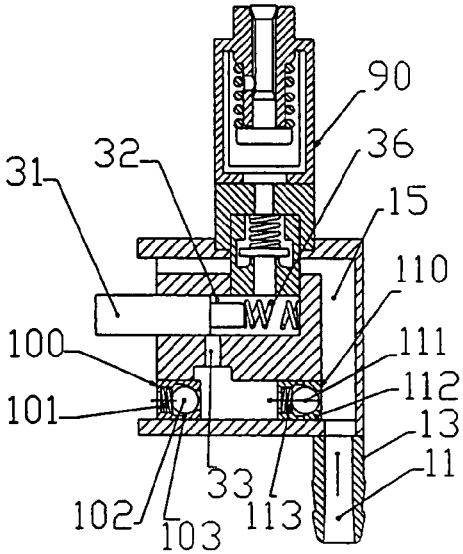
FIG. 8 is a partially schematic view of the eighth preferred embodiment of the integrated fuel feed apparatus of the present invention.

Embodiment 8: as depicted in FIG. 8, a further improvement to the plunger pump 30 of embodiment 1 features that the drain passage 33 communicates with the fuel return passage 15 via the check-spill valve 100, the fuel return passage 15 and the pressure chamber 32 are communicated with one another via the drain passage 33 of the suction-check valve 110 and the intake of the suction-check valve 110 is disposed on the fuel return passage 15.

The check-spill valve 100 comprises a valve chest 102, a spring 101 and a valve seat 103 wherein the spring 101 may not be adopted if the valve chest 47 can drop under gravity. The suction check valve 110 comprises a valve chest 111, a spring 113 and a valve seat 112, which is of a conventional check valve configuration.

At the beginning of the operation of the plunger 31, some of the fuel together with fuel vapor within the pressure chamber 32 is introduced into the fuel return passage 15 via the check spill valve 100 from the drain passage 33. The plunger 31 continues moving down and closes the drain passage 33, and the fuel in the pressure chamber 32 is pressurized; when the pressure in the pressure chamber 32 rises to the predetermined level, the fuel is ejected via the fuel injector 90.

When the solenoid is deenergized, the plunger 31 begins to reset under the reaction of the spring 36 and the fuel suction stroke begins; the fuel flows into the fuel return passage 15 via the intake passage 11, and then into the pressure chamber 32 via the suction-check valve 110 from the drain passage 33; then the check-spill valve 100 is closed to make it impossible for the residual fuel vapor to flow into the pressure chamber 32.

This simplified configuration can miniaturize the integrated fuel feed apparatus.

See embodiment 1 for other aspects.

Figure 9:
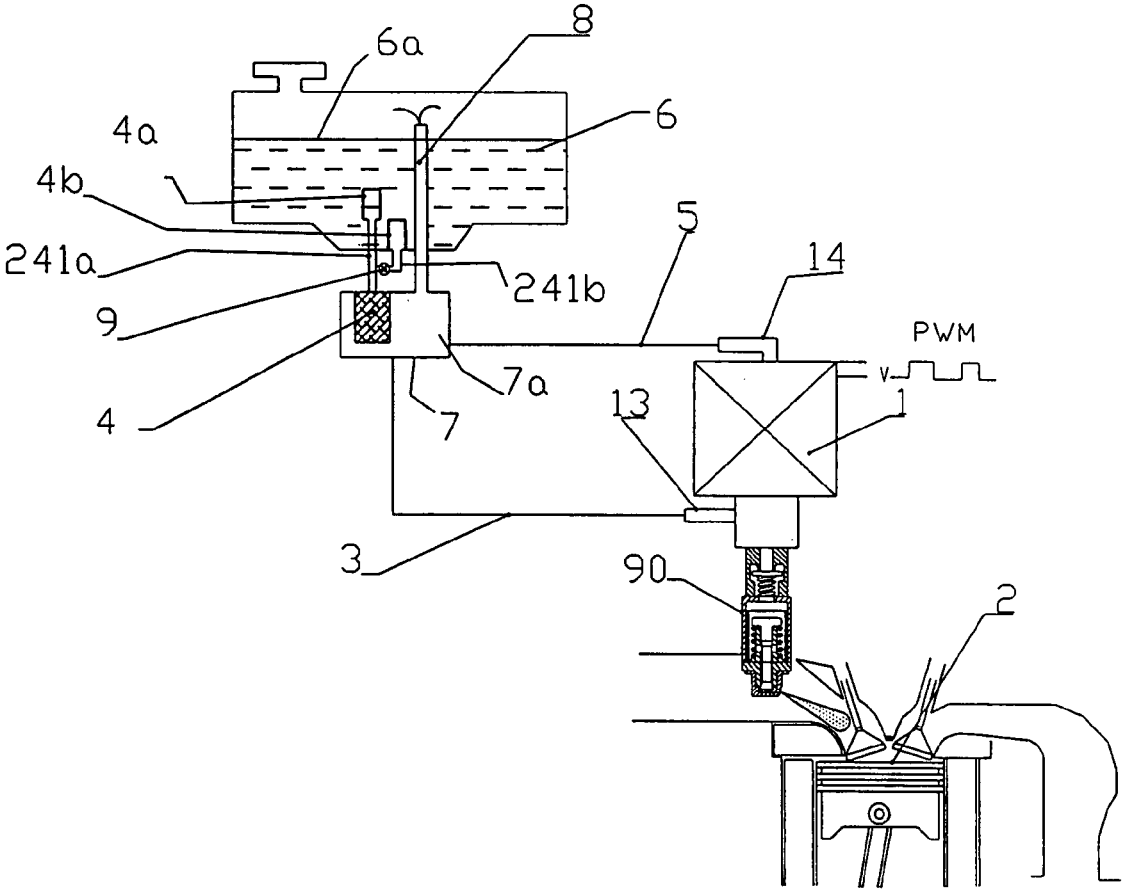
FIG. 9 is a diagrammatic view of a preferred embodiment of the present invention applied on an engine fuel feed system.

Embodiment 9: FIG. 9 depicts a practical application of the integrated fuel feed apparatus disclosed in the present invention on engines.

The fuel in the fuel tank 6 flows into the cavity 7*a* of the vapor-liquid separator 7 via a filter 4*a*, a tank passage 241*a*, an optional filter unit 4 and another optional spare passage comprising a spare filter 4*b*, a spare tank passage 241*b* and a fuel cock 9. The optional spare passage functions only when the fuel level 6*a* is lower than the intake of the filter 4*a* by opening the fuel cock 9. The fuel in the cavity 7*a* flows to the fuel intake member 13 of the integrated fuel feed apparatus of the present invention via the intake passage 3, some fuel is injected into the admission passage (cylinder) of the engine 2 via the fuel injector 90 and the rest is discharged via the fuel return member 14 and returns back into the cavity 7*a* of the vapor-liquid separator 7 via return passage 5.

The integrated fuel feed apparatus 1 of the present invention wherein the fuel vapor is introduced into the cavity 7*a* of the vapor-liquid separator 7 by the return flow; then the fuel vapor is discharged above the fuel level 6*a* of the fuel tank 6 via gas exhaust pipe 8, the intake of which is above the cavity 7*a* and the outlet thereof is always above or near the fuel level 6*a*.

The invention claimed is:

1. An integrated fuel injection apparatus comprising a driving member, a plunger pump driven by said driving member, a fuel injection member, a fuel intake member and a fuel return member, with a return passage always communicating the fuel intake member with the fuel return member, with some of the fuel in the return passage being ejected via the fuel injection member under the action of the plunger pump, characterized in that the driving member comprises a solenoid, a sleeve and a motion part which can reciprocate in the sleeve driven by the magnetic force of the solenoid, the aforesaid motion part reciprocating in a flow difference generating mode in the aforesaid return passage, thereby making the fuel flow from the fuel intake member to the fuel return member, wherein the motion part comprises an armature, and an armature passage serially communicating with the aforesaid return passage, wherein the flow area of the armature passage at the intake in fuel return direction is equal to or larger than that at the outlet thereof.

2. The integrated fuel injection apparatus of claim 1 wherein the armature passage penetrates through the armature in the center.

3. The integrated fuel injection apparatus of claim 2 wherein an arched force transfer part is fixed crossing the intake of the moving return passage at the front end of the armature such as not to influence the fuel return flow while the armature is driving the plunger pump.

4. The integrated fuel injection apparatus of claim 2 wherein the resetting motion of the armature in fuel return direction is restricted by the aforesaid fuel return member; a boss is fitted surrounding the outlet of the armature passage at the rear end of said armature and a shoulder bore locating on the fuel return member is set to receive the boss and have a matching shape with the boss.

5. The integrated fuel injection apparatus of claim 1 wherein the fuel return member comprises a return route serially communicating with the return passage; the return route comprises a rectifying section where the flow coefficient of the fuel in fuel return direction is larger when the fuel flows through the rectifying section in both directions.

6. The integrated fuel injection apparatus of claim 1 wherein the armature passage is disposed between the armature and the sleeve.

7. The integrated fuel injection apparatus of claim 1 wherein the motion member also comprises a fuel return driving member synchronized with the armature; the fuel return driving member is disposed between the fuel return member and the armature and a moving return passage is serially communicated with said return passage.

8. The integrated fuel injection apparatus of claim 1 wherein the plunger pump comprises a plunger and a pressure chamber matching with said plunger to deliver fuel, a suction-drain passage is fitted between the pressure chamber and said return passage, and the plunger driven by said motion part reciprocates to fulfill the fuel suction/delivery operation; when the plunger is in suction stroke, fuel enters the pressure chamber via the suction-drain passage and at the beginning of fuel delivery operation, some of the fuel or fuel vapor within the pressure chamber is discharged via the suction-drain passage and when said suction-drain passage is closed by the motion of the plunger, the effective fuel delivery operation begins.

9. The integrated fuel injection apparatus of claim 8 wherein a suction check valve is fitted between the pressure chamber and the return passage; when the plunger is in suction stroke, fuel enters the pressure chamber first via the suction check valve and then via the suction-drain passage, and when the plunger is at the beginning of fuel delivery operation, some of the fuel or fuel vapor in the pressure chamber is discharged via the suction-drain passage and when said suction-drain passage is closed by the motion of the plunger, the effective fuel delivery operation begins.

10. The integrated fuel injection apparatus of claim 9 wherein a spill check valve communicating with said return passage is serially communicated with said suction-drain passage, therefore only via said suction check valve 40 can the fuel enter the pressure chamber.

11. The integrated fuel injection apparatus of claim 8 wherein the suction-drain passage leads to said return passage by means of a spill check valve and a fuel intake is fitted on the suction check valve in the return passage to communicate with the pressure chamber via said suction-drain passage.

12. The integrated fuel injection apparatus of claim 9 wherein a micromatic flow adjuster, comprising an orifice and a screw, is fitted between the pressure chamber and the return passage, with the orifice communicating the pressure chamber with the return passage and screw controlling the fuel flow through the orifice or even cutting it off.

13. The integrated fuel injection apparatus of claim 9 wherein a filter that can prevent bubbles or impurities from entering the pressure chamber is fitted at the intake of the suction check valve or the suction check valve.

14. The integrated fuel injection apparatus of claim 1 wherein fuel injection member is the injection orifice.

15. The integrated fuel injection apparatus of claim 1 wherein the fuel injection member comprises a delivery valve and an atomizing nozzle.

16. The integrated fuel injection apparatus of claim 15 wherein the delivery valve comprises a valve body, a valve seat and a spring; the valve body may adopt a spherical shape and the valve seat an axisymmetric curved surface, or a planar sheet for the valve chest and an elastic part for the valve seat.

17. The integrated fuel injection apparatus of claim 15 wherein the atomizing nozzle comprises a nozzle body, a nozzle stem and a spring; the conical or spherical section at the front end of the nozzle stem forms the nozzle body with an intake orifice thereon and the conical section on the nozzle body forms the nozzle seat; a spring seat is fitted at the rear end of nozzle stem and the axial clearance between it and the nozzle body defines the maximum lift of the nozzle stem.

18. The integrated fuel injection apparatus of claim 17 wherein the atomizing nozzle also comprises an injection guide cap disposed at the intake thereof with one or several holes thereon.

19. The integrated fuel injection apparatus of claim 17 wherein the ratio of the maximum flow area and the sectional area of the plunger should be limited below 0.025 when the nozzle stem opens.

20. The integrated fuel injection apparatus of claim 1 employed on a combustion engine, by which the fuel is injected into the intake port or cylinder.

* * * * *